United States Patent [19]

Piquet et al.

[11] 4,400,092

[45] Aug. 23, 1983

[54] ANALOGUE AND DIGITAL DISPLAY

[75] Inventors: Christian Piquet; Jean-Claude Martin, both of Neuchatel, Switzerland

[73] Assignee: Centre Electronique Horloger SA, Neuchatel, Switzerland

[21] Appl. No.: 272,944

[22] Filed: Jun. 12, 1981

Related U.S. Application Data

[63] Continuation of Ser. No. 116,460, Jan. 29, 1980, abandoned.

[30] Foreign Application Priority Data

Feb. 8, 1979 [CH] Switzerland ..... 1228/79

[51] Int. Cl.[3] ..... G04C 19/00; G04C 17/02; G09F 9/00

[52] U.S. Cl. ..... 368/82; 368/240; 340/756

[58] Field of Search ..... 368/71, 82–84, 368/223, 232, 239–242; 340/752, 756, 765

[56] References Cited

U.S. PATENT DOCUMENTS

| | | | |
|---|---|---|---|
| 1,096,682 | 5/1914 | Clement | 368/240 |
| 1,096,778 | 5/1914 | Clement | 368/240 |
| 3,444,319 | 5/1969 | Artzt et al. | 340/756 |
| 3,596,462 | 8/1971 | Hates | 368/82 |
| 3,898,644 | 8/1975 | Baxter | 368/223 |
| 3,969,887 | 7/1976 | Fukamoto | 368/240 |
| 3,982,239 | 9/1976 | Sherr | 368/239 |
| 4,198,810 | 4/1980 | Fahrenschon | 368/239 |

*Primary Examiner*—Vit W. Miska
*Attorney, Agent, or Firm*—Wender, Murase & White

[57] ABSTRACT

A combined analogue and digital display device having a plurality of individually energizable display elements arranged symmetrically with at least some of the elements common to both displays. Several of the elements are disposed so as to form groups of segments or zones, each group representing one digit of the digital display. Several others of the elements are disclosed radially to form an analogue display for simulating a parameter, such as time, by representing an hours hand and a minutes hand.

7 Claims, 20 Drawing Figures

ANALOGUE AND DIGITAL DISPLAY

This is a continuation of application Ser. No. 116,460, filed Jan. 29, 1980, now abandoned.

BACKGROUND OF THE INVENTION

The present invention relates to an analogue and digital display device comprising segments or zones as display elements.

Watches having an analogue and a digital display are already known. For example, the model ref. 5893 Omega Chrono-Quartz comprises an analogue display of the time by hands driven by a stepping motor and a digital display of the liquid crystal type (LCD) for the chronograph function. The two displays are entirely distinct from each other and they have no common function.

The patent U.S. Pat. No. 4,095,405 describes an electronic watch with an analogue display of the hours and a digital display of the date. The analogue display is formed of two concentric rings each comprising 60 segments (LED) disposed radially. The segments are successively activated in order to simulate the movement of hours and minutes hands. The digital display is conventional, with seven segments, and it is disposed in the center of the watch. Due to the fact that the two displays are entirely separated from each other and that they have no common function, the number of segments which are necessary for displaying the hours with a definition of one minute is relatively high (60 segments per ring, that is a total of 120 segments).

Various types of digital displays are known in which the numbers 0–9 are formed by different combinations and configurations of display elements.

The patent CH No. 584 441 describes a digital display which, due to a particular disposition of its segments,-needs only six of the latter to form the numbers 0–9.

The patent CH No. 584 439 describes another digital display comprising only six display elements, one of these being common to all digits.

Such displays are nevertheless very specific and they are not well suited for a double display, analogue and digital.

SUMMARY OF THE INVENTION

It is an object of the present invention to realize a display comprising a relatively small number of elements, these elements being utilized for both an analogue and a digital display.

According to the present invention, the display elements are geometrically arranged according to a broadly central symmetry, at least part of said display elements being common to said analogue display and to said digital display.

For a watch, the advantages of an analogue display are to allow a rapid reading of the hours and the minutes. The digital display is appreciated for indicating the data, the seconds, the chronograph function, and so on.

The advantages of a double electronic display, analogue and digital, having segments or zones as display elements are the elimination of the mechanical stepping motor and of the large power transistors which are normally required to control the stepping motor. The display according to the present invention has another advantage: the number of segments it comprises is about the same as that of the watches having entirely numerical displays. Moreover, only a single time setting is required for the two displays, analogue and digital, which is not the case when a digital watch is equipped with a motor driving conventional hands.

The present invention will be described further, by way of example, with reference to the accompanying drawings.

For the sake of clarity, FIGS. 1–5 and 7 have (a) the disposition of the set of the display elements, (b) an example of the analogue display, (c) an example of the digital display.

DESCRIPTION OF THE PREFERRED EMBODIMENTS

Figure 1A:
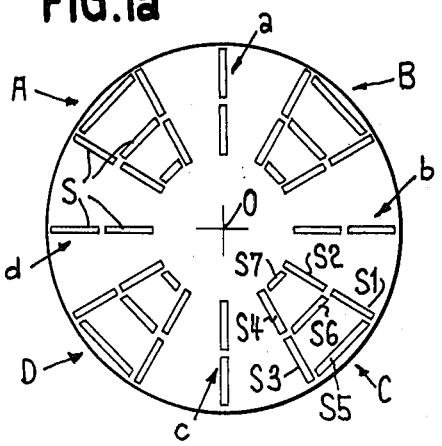
FIGS. 1*a*–1*c* to 5*a*–5*c* are diagrammatic plan views each showing an embodiment of a display according to the present invention.

FIG. 1*a* shows a circular display having a substrate or base with its center marked "0" and comprising 36 display elements or segments S arranged as illustrated. By display element is meant one part of a display of the type LED (light emitting device), LCD (liquid crystal device), ECD (electrochromic device), and so on, having two different optical states according to the conditions of electrical excitation. Such elements are well known in the art and are not described in detail herein solely for the sake of brevity. It is to be seen that the 36 segments S form 4 groups A–D, each of 7 segments S1–S7, having a relative disposition like that of a conventional digital display of a digit with 7 segments. The 8 remaining segments are distributed in 4 groups a–d, each comprising 2 segments and each group being disposed radially respectively between two of the groups A–D of 7 segments. FIG. 1*a* shows that the segments are arranged according to a central symmetry with respect to the center O of the display.

Figure 1B:
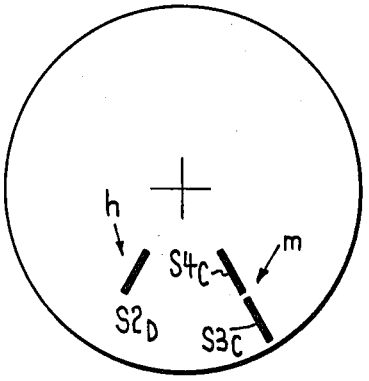

FIG. 1*b* shows a first utilization of at least part of the segments S of the display of FIG. 1*a* for an analogue display by simulation of an hours hand h and a minutes hand m. For simulating the minutes hand m, the segments S1–S4, disposed radially, of the groups A–D as well as those of the groups a–d are required. The hours hand h, which is shorter than the minutes hand m, requires only the radial central segments of the groups a–d and the segments S2 and S4 of the groups A–D. In the example of FIG. 1*b*, the hours hand h is simulated by the activation of the central segment $S2_D$ of the group D and the minutes hand m by the activation of the two radial segments $S3_C$ and $S4_C$ of the group C. The definition of the analogue display according to FIG. 1 is of 5 minutes; in other words, the minutes hand m advances one equidistant angular step every 5 minutes.

Figure 1C:
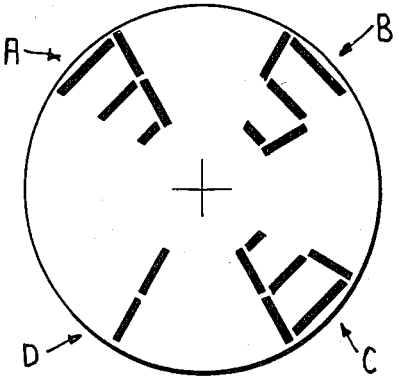

FIG. 1*c* shows that the groups A–D of 7 segments each are utilized for the digital display. Each group represents one digit. The two upper digits A and B are utilized for example for indicating the seconds (35) and the two lower digits D and C for indicating for example the date (16). These 4 digits may also display, if required, the hours and the minutes with a definition of 1 minute. It is clear that these digits may be utilized for displaying any other determined parameter of the timepiece and that they are not required to be utilized by pairs. A comparison of the FIGS. 1*b* and 1*c* shows that in the selected examples, the analogue display which indicates 7h25 utilizes the segments $S3_C$, $S4_C$ and $S2_D$ of the groups C and D which are also needed for indicating the number 16 on the digital display. This results in a double utilization of the segments of the analogue display, so that the analogue readout is at least temporary disturbed. For this reason, when the double display according to the present invention is utilized, the analogue and the digital displays are never simultaneously activated. In a preferred embodiment, only the analogue display will be permanently activated and, with the help of a control means not represented, the digital display will be activated only when desired by the user of the device, the analogue display being then temporarily disabled.

Figure 2A:
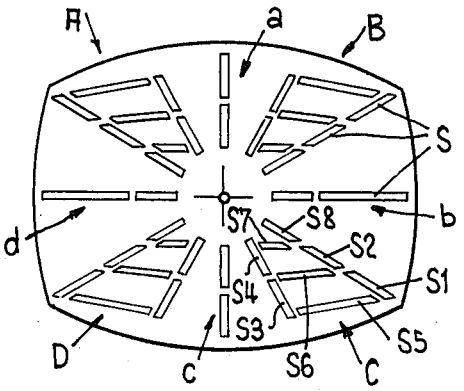

FIG. 2*a* shows a display having an oval shape and comprising 40 segments S arranged according to a central symmetry. Like in the preceding embodiment, the 40 segments determine 4 groups A–D of 8 segments S1–S8 each, the 7 segments S1–S7 of each group being disposed so as to permit the display of a digit with 7 segments. The segment S8 and the remaining segments which are distributed in 4 groups a–d of 2 segments each and placed respectively between two of the groups A–D are utilized exclusively for the analogue display. This disposition improves the aesthetics of the analogue display because it allows the minutes hand to start always from the same radius by utilizing, at certain hours, the segment S8 as a third segment in the simulation of this minutes hand. Taking advantage of the oval form of the watch, the external segments of the groups b and d are made longer than the internal segments which also contributes to improve the aesthetics of the presentation of the watch. Like in the preceding embodiment, the definition of the analogue display is 5 minutes. The digital display with 4 digits is combined in two groups of 2 digits each, respectively disposed over and under the center of the watch.

Figure 3A:
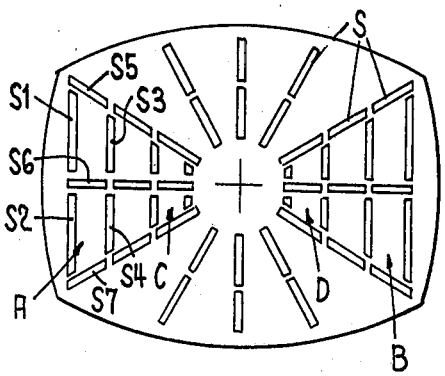
Figure 3B:
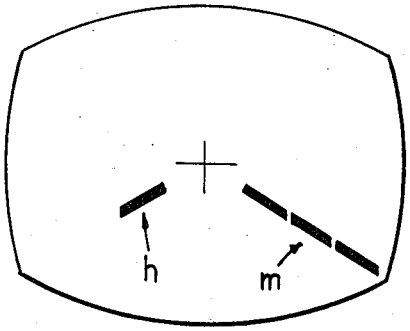
Figure 3C:
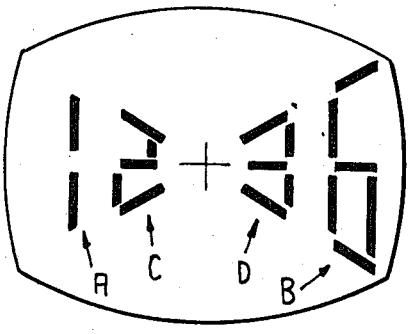

FIG. 3 shows a display having an oval shape and comprising 46 segments S arranged according to a central symmetry. These 46 segments determine as shown in FIG. 3*b* and 3*c* respectively an analogue display having a definition of 5 minutes and a minutes hand of variable length for facilitating the analogue reading of the time and a digital display comprising 4 digits A–D of 7 segments each. These 4 digits are distributed in two groups each comprising 2 digits disposed one against the other in a line, which greatly improves the legibility of the quantities which are digitally displayed. It is clear that a display like the one of FIG. 3 may also be applied to a watch having a circular shape.

Figure 4A:
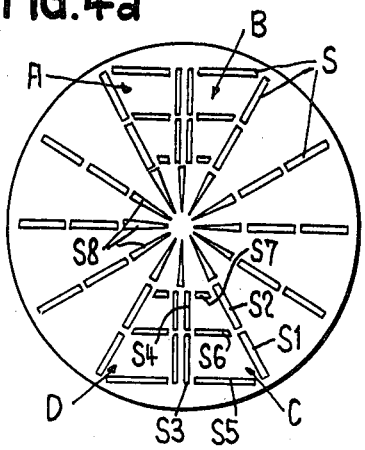
Figure 4B:
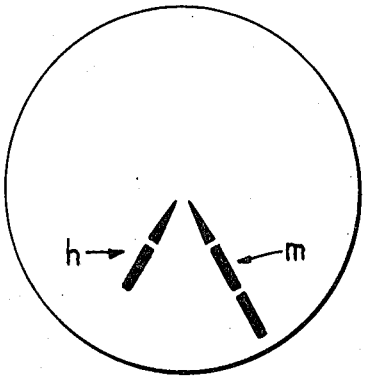
Figure 4C:
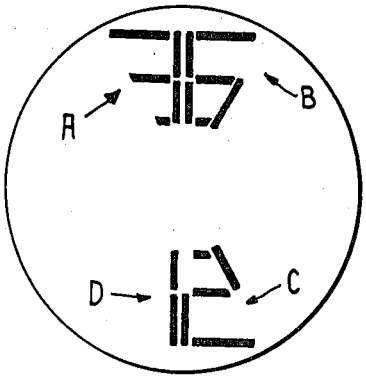

FIG. 4 shows an embodiment of the display with 52 segments S arranged according to a central symmetry. These 52 segments may be activated to simulate an hours hand h and a minutes hand m and to display 4 digits A–D, each of 7 segments. The analogue display has a definition of 5 minutes. It is to be seen that the hand at 6 and 12 hours is doubled, this particular disposition of the segments improving greatly the legibility of the digital display with 4 digits disposed in two groups of 2 digits each placed respectively over and under the center of the watch. The display comprises 12 segments S8, which may be triangularly shaped, arranged radially and providing a perfect representation of the hands of the analogue display. The 12 central segments S8 of FIG. 4 could also be incorporated to the displays of FIGS. 1, 2 and 3 and the display of FIG. 3 could also be completed, if necessary, by the 4 digits of FIG. 4; in this case, it would comprise 62 segments and it would display 8 digits of 7 segments each.

Figure 5A:
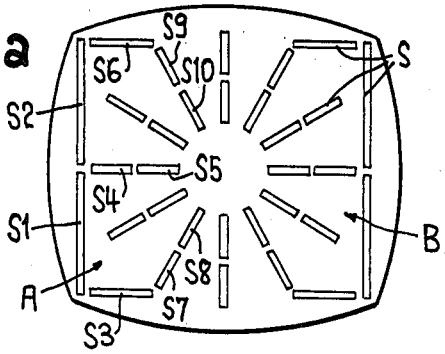
Figure 5B:
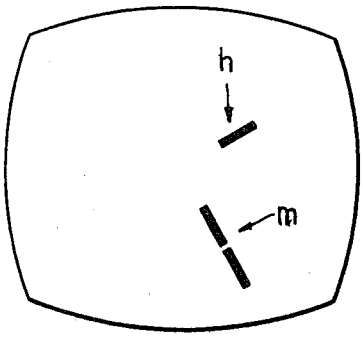
Figure 5C:
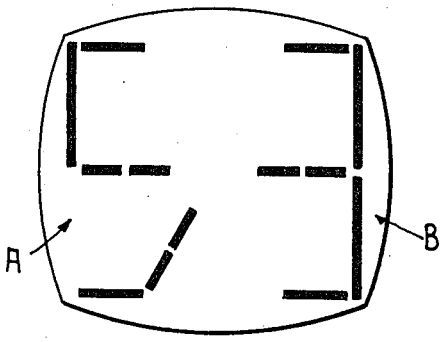
Figure 6A:
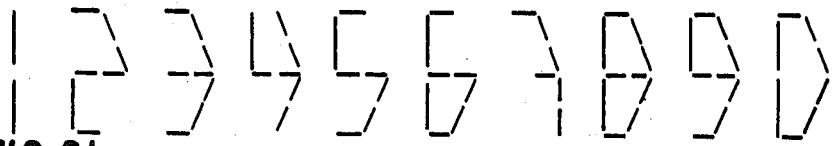
FIGS. 6*a* and 6*b* are graphical representations of symbols which are capable of being formed by the configuration of the segments of the embodiment of FIGS. 5*a*–5*c* of the present invention.
Figure 6B:
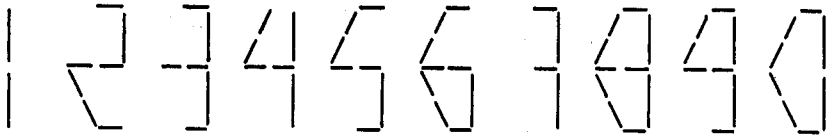

FIG. 5 shows a display with 32 segments S arranged according to a central symmetry. It provided an analogue display of hours and minutes with a definition of 5 minutes by simulating an hours hand h and a minutes hand m. This embodiment further has the capability to display digitally 2 digits A and B having 10 segments S1–S10 each. FIG. 6 shows the graphical representation of the numbers 0–9 which are capable of being formed with the help of the 10 above mentioned segments. FIGS. 6*a* and 6*b* show respectively the left (A) and right (B) symbols of FIG. 5.

Figure 7A:
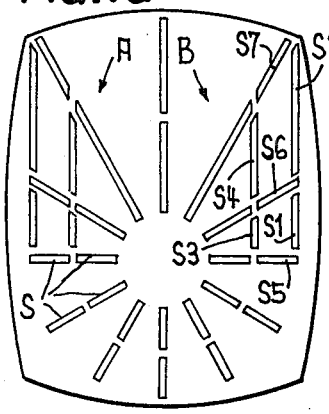
FIGS. 7*a*–7*c* are diagrammatic plan views of a further embodiment of the display according to the present invention.
Figure 7B:
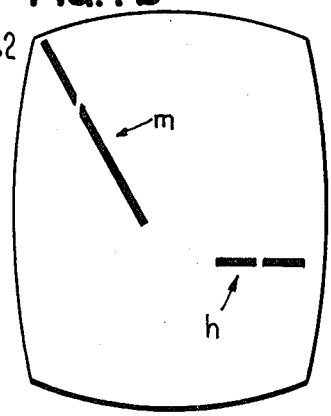
Figure 7C:
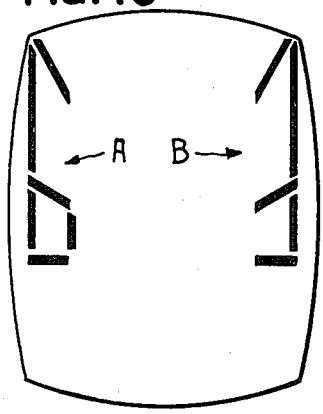

FIG. 7 shows a display with 32 segments for simulating an hours hand h and a minutes hand m for displaying the time in analogue form with a definition of 5 minutes and two in digital form with digits A and B having 7 segments each. FIG. 7 illustrates an application of the display in a watch of oval shape. The aesthetics is not conventional because the center of the analogue display is displaced in the lower part of the dial of the watch.

Figure 2B:
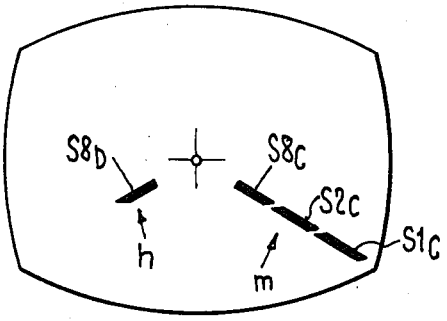
Figure 2C:
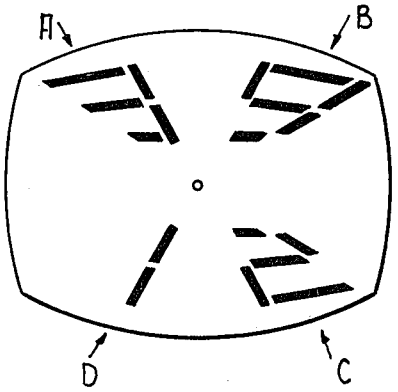

If the number of segments of the display of FIGS. 1, 2 and 3 is doubled, the analogue display can display the time with a definition of $2\frac{1}{2}$ minutes and it is possible to provide a digital display comprising 8 digits of 7 segments each.

It is clear that the invention is not limited to the embodiments described above and that more particularly every analogue and digital display having at least some elements common to both and arranged with the analogue elements disposed radially at equidistant angular positions is part of the present invention. Also, the display is not exclusively provided for the indication of time. For example, the analogue display could be utilized for a speed counter of a vehicle and the digital display for the mileage indicator or for indicating the value of any other parameter of the same vehicle.

What we claim is:

1. A combined analogue and digital display, comprising:

a substrate;

a plurality of first display groups disposed on said substrate, each of said first groups being radially arranged about a point and being spaced from each other by an equidistant angular amount on said substrate and each of said first groups further including a plurality of individually energizable first elongated display elements aligned linearly along a radius to form an analogue display simulating the position of at least one hand on a dial; and a plurality of second display groups, each of said second groups including individually energizable second elongated display elements disposed on said substrate in proximity to said first elongated display elements, each of said second groups being arranged to cooperate with at least some of said first display elements to form at least two digital display arrays, each capable of selectively displaying any single digital character for displaying time.

2. A display device according to claim 1 wherein said second display elements are interspaced between said radially arranged first display elements.

3. A display device according to claim 1 wherein said second display elements are disposed circumferentially relative said point of said substrate.

4. A display device according to claim 1, wherein at least three of said first display elements are linearly disposed along a radius extending from said point of said substrate.

5. A display device according to claim 1, wherein said character of said digital display array is formed of each at least seven display elements, at least one of which is a first display element and at least another one of which is a second display element.

6. A display device according to claim 1, wherein at least some of said first display elements are radially tapered.

7. A display device according to claim 6 wherein said radially tapered elements are triangular.

* * * * *